United States Patent [19]

Burysek et al.

[11] 4,013,242

[45] Mar. 22, 1977

[54] COP TUBE HOLDER FOR WINDING YARNS OR THREADS ON TEXTILE MACHINES

[75] Inventors: Frantisek Burysek, Usti nad Orlici; Karel Mikulecky, Chocen; Zdenek Havranek, Usti nad Orlici, all of Czechoslovakia

[73] Assignee: Vyzkumny ustav Bavlnarsky, Usti nad Orlici, Czechoslovakia

[22] Filed: Nov. 18, 1974

[21] Appl. No.: 524,534

[30] Foreign Application Priority Data

Nov. 19, 1973 Czechoslovakia ..... 7932/73

[52] U.S. Cl. ..... 242/129.51; 242/130

[51] Int. Cl.[2] ..... B65H 49/00

[58] Field of Search ..... 242/129.51, 129.5, 129.6, 242/130, 131

[56] References Cited

UNITED STATES PATENTS

| | | | |
|---|---|---|---|
| 3,131,885 | 5/1964 | Furst et al. | 242/129.51 |
| 3,831,869 | 8/1974 | Sartori | 242/18 DD |

*Primary Examiner*—Leonard D. Christian

[57] ABSTRACT

Cop tube holder for winding yarns or threads on textile machines, and more particularly on open-end spinning machines with an automatic cop exchange, provided with a pair of bent levers adapted to swing in the holder and carrying rotatable dishes for placing the front portions of the tube while the operating pressure necessary for clamping a tube between the dishes is exerted by a spring. The bent levers are motion-coupled to each other by means of a kinematic pair.

2 Claims, 12 Drawing Figures

COP TUBE HOLDER FOR WINDING YARNS OR THREADS ON TEXTILE MACHINES

The present invention relates to a cop tube holder for winding yarns or threads on textile machines, and more particularly on open-end spinning machines with automatic cop exchange.

As known, in textile machinery there are used various devices for clamping a cop tube in package winding processes. The device which has been mostly used in practice is a holder carrying two arms on which dishes for placing the front portions of the tubes are journalled. As a rule, the holder body is made tiltable and adapted to be forced, due to the action of a spring, weight, or the like, onto a drive drum to rotate the tube during the spooling process. One of the afore-mentioned arms is usually fixed in the holder while the other is made movable, i.e. to swing or reciprocate while a spring is provided to exert an operating pressure on the two arms necessary for clamping the tube between the dishes. When the full cop is to be removed from the holder, the movable arm has to be tilted or shifted away against the action of e.g. the spring in order to release the tube from between the dishes. Thus, any exchange of the full cop for an empty tube requires extra free space in the axial direction of the package so that the operating width of an open-end spinning unit has to be larger than the actual length of the package. In case the operating width of the spinning station is fully occupied by the package length, the exchange has to be effected in any other than spooling position so as to enable the holder arms to be opened. Such a practice results in breaking the yarn take-off and renders automatic cop exchange rather complicated and troublesome.

In an endeavor to minimize the spacings separating the arrayed units of open-end spinning machines from each other, holders have been proposed with arms which are movable so that in the doffing step both dishes can be tilted away from each other. In this way it is possible to reduce the necessary space to one half. With these holders constructions, each of the arms is controlled individually, which means without any mutual coupling, or in common by means of rather intricate lever or Bowden transmission devices which are relatively expensive, and moreover, have high rates of failure.

In order to eliminate or at least mitigate the disadvantages of the prior art, we provide a cop tube holder for winding yarns or threads on textile machines, and more particularly on open-end spinning machines with an automatic cop exchange which are provided with a pair of bent levers adapted to swing in the holder and carry rotatable dishes for placing the front portion of the tube while the operating pressure necessary for clamping a tube between the dishes is exerted by a spring. The holder in accordance with the invention, has the bent levers motion-coupled to each other by means of a kinematic pair.

This holder arrangement is simple and very reliable in operation. The bent levers, namely, are motion-coupled in such a manner that any tilting of one lever results in the same movement of the other lever but in the opposite direction.

Among the most preferred embodiments of the present invention there can be named:

a general kinematic pair constituted by two mating surfaces of two connecting arms of said bent levers, which surfaces are forced to each other while a surface of one of said connecting arms is provided with a protuberance to be forced against a surface of the second connecting arm;

a general kinematic pair constituted by a pin provided on one of the connecting arms, and by a slot provided in the second connecting arm, said pin being received by said slot;

a kinematic pair constituted by a block provided on one of the connecting arms, and by a guideway provided in the second connecting arm, said block being received by said guideway;

a general kinematic pair constituted by two connecting arms embodied as rack segments adapted to mesh with each other;

a rolling kinematic pair constituted by two connecting arms having circular segments forced against each other;

a kinematic pair constituted by a spring joint linking the two connecting arms, the bent levers also being supported by the holder on the spring joints;

a rotational kinematic pair constituted by a hinge joining the two connecting arms to each other, the bent levers being supported by the holder on the spring joints;

a rolling kinematic pair constituted by two mating surfaces of the connecting arms facing each other, and by a cylindrical pressure element inserted between said surfaces, the force engagement between the kinematic pair of elements being effected by a spring; and a rolling kinematic pair constituted by two notches cut out in the connecting arms and facing each other, and a double-edged prism inserted between said notches, the force engagement between the kinematic pair of elements being effected by a spring.

In order that the invention be better understood and carried into practice some preferred embodiments thereof will be now described with reference to the accompanying schematic drawings in which.

Figure 1:
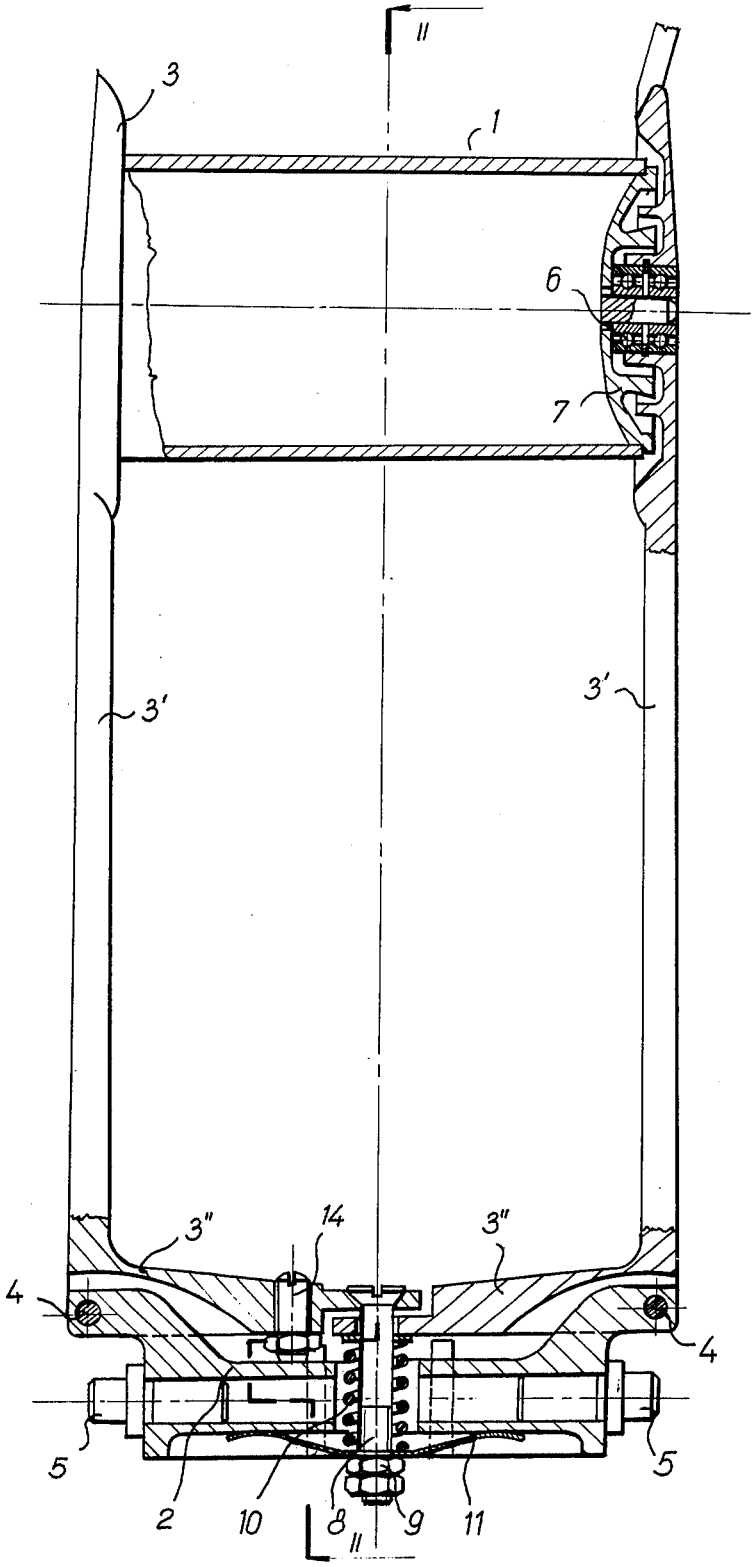
FIG. 1 is a frontal, partially sectional view of an embodiment of tube holder.
Figure 2:
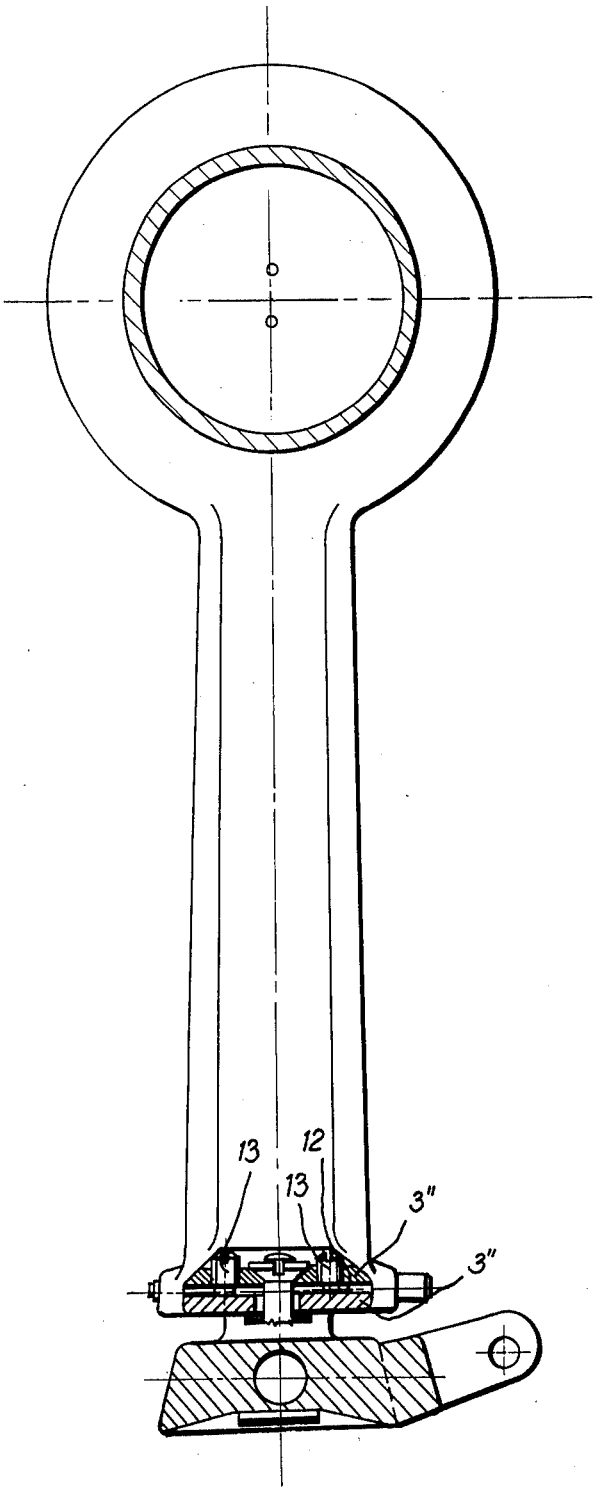
FIG. 2 is a sectional view taken along the line II-II in FIG. 1.

As can be seen in FIGS. 1 and 2, the illustrative holder of a cop tube 1 comprises a body 2 and a pair of bent levers 3 pivotally supported at 4 by said body 2. The body 2 is mounted to rotate about pivots 5 secured in the machine frame (not shown). The bent levers 3 comprise respective clamping arms 3 disposed opposite each other and connecting arms 3″ extending towards each other. The clamping arms 3′ are provided with bearings 6 adapted to carry dishes 7 to receive the front portions of the cop tube 1.

In proximal central extremities of the connecting arms 3″ overlapping each other, there are provided co-axial borings to receive a bolt 8 which also passes through a central hole provided in the body 2. The head of the bolt 8 bears upon the extremity of the connecting arm 3'' which is spaced from the body 2. Between the extremity of the second connecting arm 3'' which is adjacent to the body 2, and the nut 9 of the bolt 8, there are disposed a helical thrust spring 10 as well as a flat spring 11, which latter bears upon the surface of the tube holder body 2 remote from the connecting arms 3''.

A first embodiment of the kinematic pair of the bent levers 3 is shown in FIG. 2. It is constituted by a surface of one of the connecting arms 3'' together with a mating surface of the second connecting arm 3'', which last-mentioned surface is forced against said first surface by the helical thrust spring 10 and which forms, in the illustrated embodiment, a bearing surface for a pair of adjusting grub screws 13.

The flat spring 11 is adapted to push, by means of the bolt 8 and said kinematic pair, the connecting arms 3'' towards the body 2 whereby it forces the clamping arms 3' together with the dishes 7 toward each other. The afore-said tilting movement of clamping arms 3' toward each other is limited by a stop screw 14 adjustably mounted in the connecting arm 3'' and forced by the action of the flat spring 11 onto the body 2 (FIG. 1).

Since the helical thrust spring 10 forces the two connecting arms 3'' toward each other, it produces a steady mutual force of engagement of the kinematic pair elements. If, namely, on an exchange of a full package for an empty tube, one clamping arm is tilted off, the other clamping arm 3' is also simultaneously tilted off by the same distance. After the pair of the bent levers 3 has been opened and the full package doffed, the two clamping arms 3' again approach each other under the action of the flat spring 11 by a distance limited by the stop screw 14. The latter is adjusted as to enable the empty cop tube 1 to be inserted between the two dishes 7.

Figure 3:
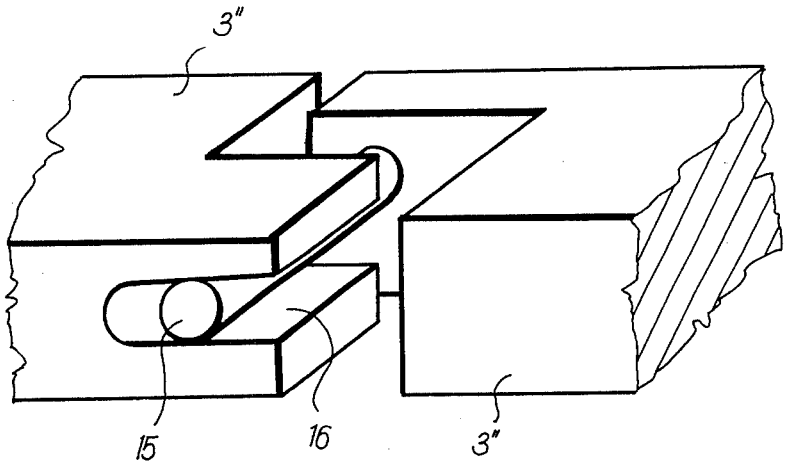
FIGS. 3 through 10 are detail views of the holder, showing eight additional embodiments of the kinematic pairs for controlling the movements of the holder arms.
Figure 11:
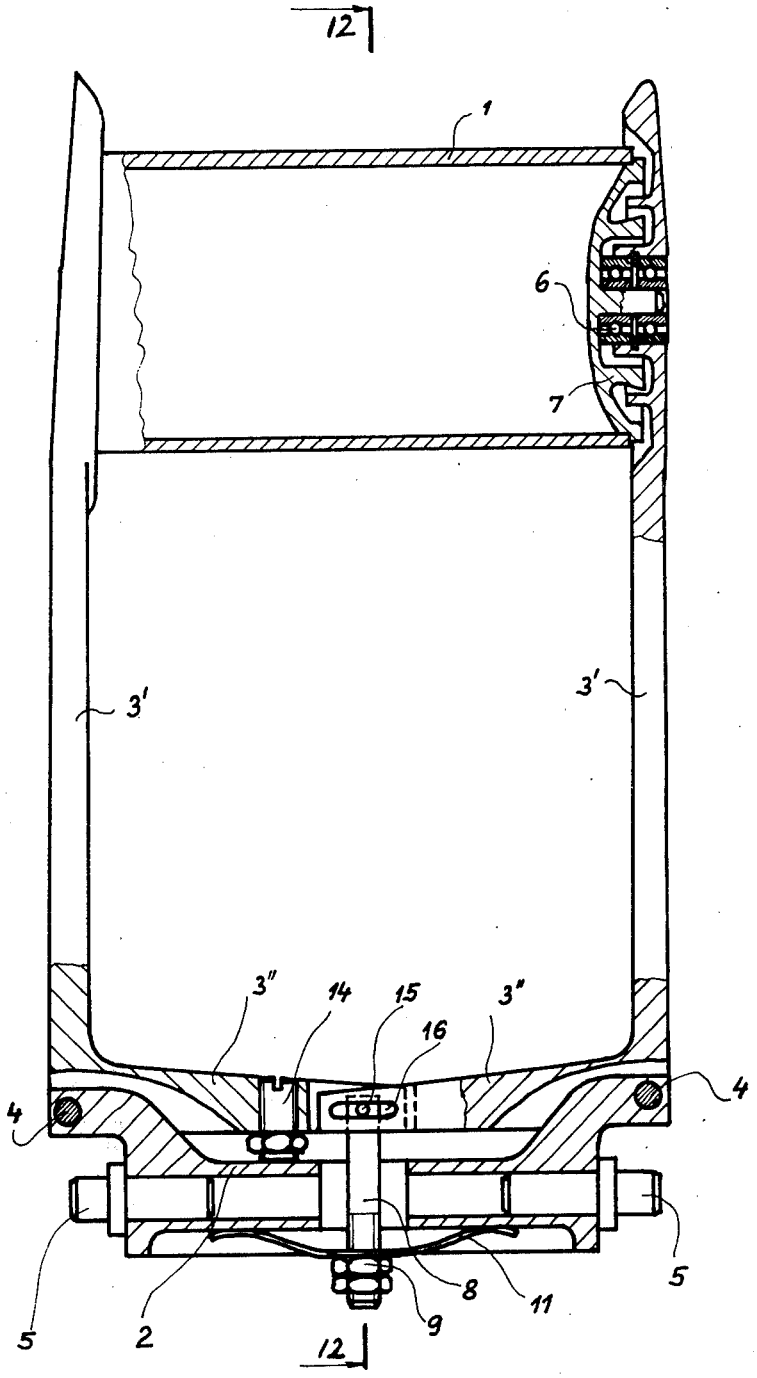
FIG. 11 is a frontal, partially sectional view of an embodiment of tube holder employing therein the kinematic pair of FIG. 3.
Figure 12:
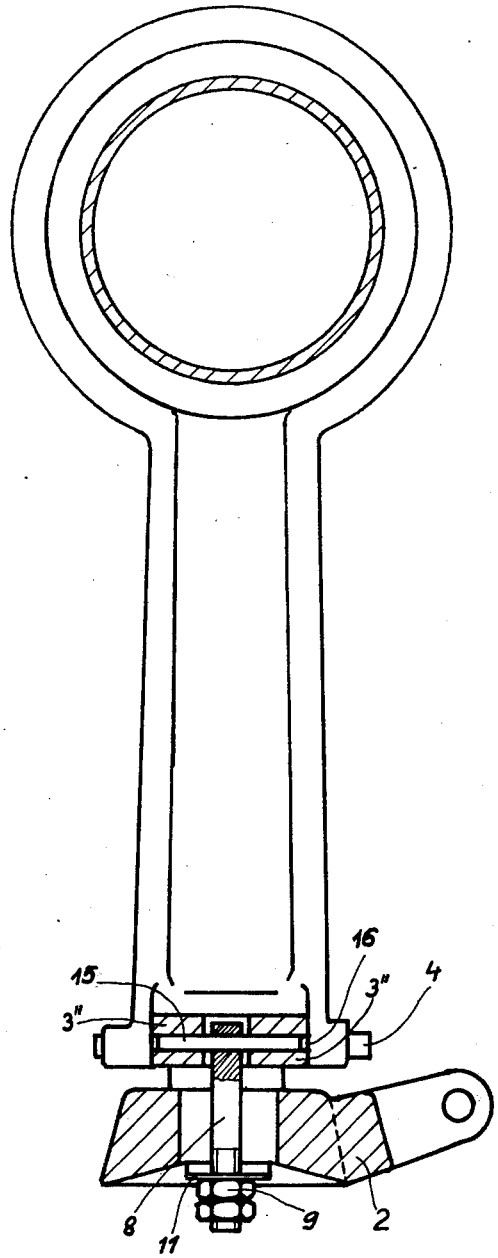
FIG. 12 is a sectional view taken along line 12–12 of FIG. 11.

FIG. 3 shows a detail view of a holder embodiment with a second embodiment of kinematic pair. Such pair is constituted by a cylindrical pin 15 secured in and extending from one of the connecting arms 3'', and by a slot 16 provided in the second connecting arm 3'', the pin 15 is being adapted to enter the slot 16 FIGS. 11 and 12, analogous to FIGS. 1 and 2, show such a pin-and-slot connection in the environment of a tube holder similar to that of FIGS. 1 and 2.

Figure 4:
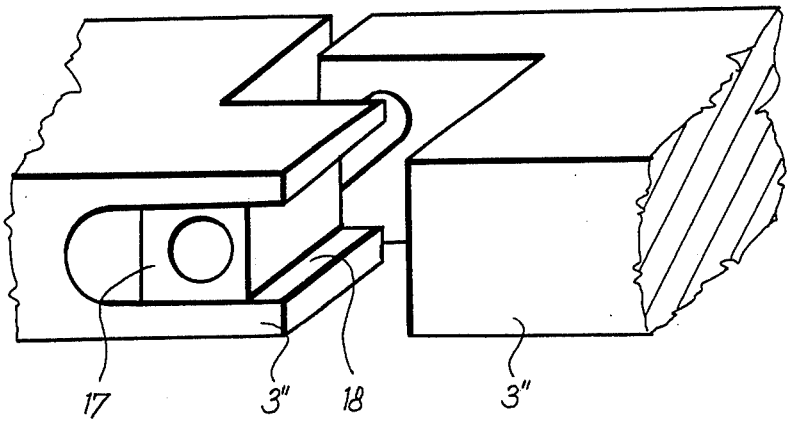

In a third embodiment of kinematic pair, illustrated in FIG. 4, the kinematic pair is formed by a rectangular block 17 supported by one of the connecting arms 3'', and by a guideway provided in the second connecting arm 3'', the block 17 being adapted to enter the guideway 18.

Figure 5:
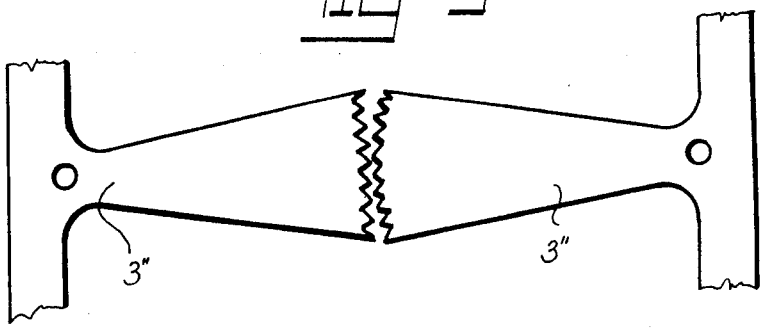

In FIG. 5, there is shown a fourth embodiment of kinematic pair; this is embodied as two connecting arms 3'' have gear segments meshing with each other.

Figure 6:
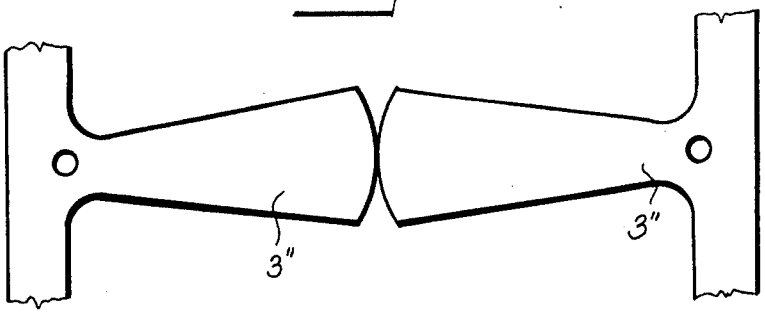

The fifth embodiment of kinematic pair, illustrated in FIG. 6, is of rolling type comprising two connecting arms 3'' the extremities of which are embodied as circular segments forced into engagement with each other.

Figure 7:
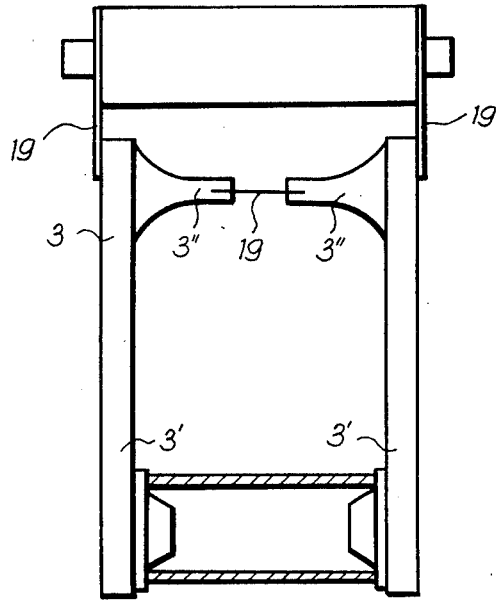

In the sixth embodiment, according to FIG. 7, the kinematic pair is constituted by a spring joint 19 linking the two connecting arms 3''. The bent levers 3 are supported by the holder also by means of spring joints 19.

Figure 8:
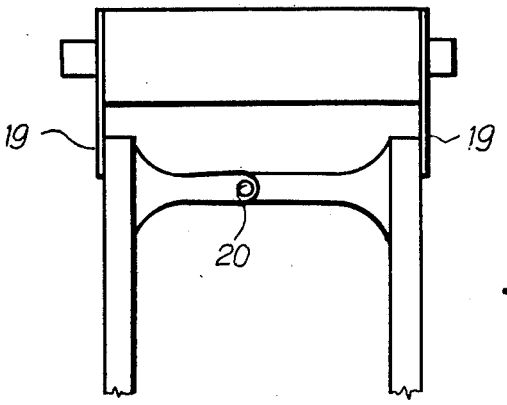

The seventh embodiment of kinematic pair shown in FIG. 8, is of a rotational type. It is formed by a hinge 20 joining the two connecting arms 3''. The bent levers 3 are supported upon the spring joints 19.

Figure 9:
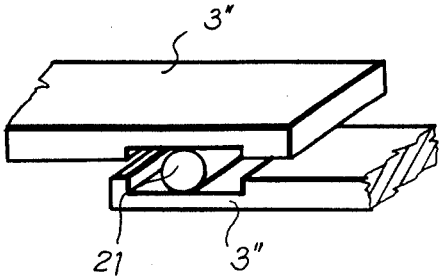

A rolling kinematic pair, the eighth embodiment, illustrated in FIG. 9, consists of two mating surfaces of the connecting arms 3'' facing each other, and a cylindrical element 21 inserted between the two surfaces. The forceful engagement of the kinematic pair of elements is accomplished in this embodiment by a spring (not shown).

Figure 10:
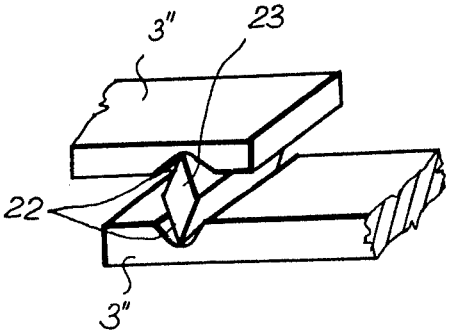

The ninth embodiment of kinematic pair, shown in FIG. 10, is of a rolling type. It comprises two mating notches 22 cut out in the connecting arms 3'' which notches face each other, and a double-edge prism 23 inserted into a space therebetween. The forceful engagement between the kinematic pair elements is effected by a spring (not shown).

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. For use in a textile machine, an apparatus for removably supporting an elongated cop tube for winding filaments, which comprises, in combination, a base, member, first and second substantially right-angled levers each having first and second arms, means for pivotally supporting the apexes of the first and second levers in opposed, confronting relation on opposite ends of the base member with the first arms of the respective lever extending substantially horizontally toward each other, rotatable cop tube mounting means carried in opposed relation on the outer ends of the respective second arms of the levers for supporting opposite ends of the cop tube, and means kinematically coupling the outer ends of the first arms of the levers and responsive to the movement of the second arm of one of the levers for imparting an equal and opposite movement to the second arm of the other of the levers.

2. Cop tube holder as claimed in claim 1, wherein the means kinematically coupling the outer ends of the first arms of the levers is constituted by a pin provided on one of such arms and by a slot provided in the other of such arms, said pin being received by said slot.

* * * * *